US008167090B2

(12) United States Patent
Michael

(10) Patent No.: US 8,167,090 B2
(45) Date of Patent: May 1, 2012

(54) APPARATUS FOR SAFELY LOWERING USER FROM STRUCTURE

(76) Inventor: Ralph L. Michael, Lake Forest, CA (US)

( * ) Notice: Subject to any disclaimer, the term of this patent is extended or adjusted under 35 U.S.C. 154(b) by 16 days.

(21) Appl. No.: 12/882,004

(22) Filed: Sep. 14, 2010

(65) Prior Publication Data

US 2012/0061183 A1 Mar. 15, 2012

(51) Int. Cl.
*B65H 75/30* (2006.01)

(52) U.S. Cl. ..... 182/231; 182/5; 182/6; 182/7; 182/233; 182/234; 242/396.5; 242/396.6; 242/381; 188/72.1; 188/72.4; 188/78; 188/184; 188/185

(58) Field of Classification Search ..... 182/5, 6, 182/7, 231, 233, 234; 242/396.5, 396.6, 242/381; 188/72.1, 72.4, 78, 184, 185
See application file for complete search history.

(56) References Cited

U.S. PATENT DOCUMENTS

| | | | | | |
|---|---|---|---|---|---|
| 612,673 | A | * | 10/1898 | Reidy | 182/235 |
| 1,122,566 | A | * | 12/1914 | Bailey | 182/238 |
| 1,144,702 | A | * | 6/1915 | Forest | 182/235 |
| 1,734,833 | A | * | 11/1929 | Shearer | 182/238 |
| 2,091,418 | A | * | 8/1937 | Schoene | 182/238 |
| 2,500,884 | A | * | 3/1950 | Tessin | 182/238 |
| 2,670,827 | A | * | 3/1954 | Sanders | 192/60 |
| 3,193,190 | A | * | 7/1965 | Lindberg | 418/86 |
| 3,241,642 | A | * | 3/1966 | King | 192/58.43 |
| 3,847,377 | A | * | 11/1974 | Byrd | 242/396 |
| 3,861,496 | A | * | 1/1975 | Hoover | 182/233 |
| 3,879,016 | A | * | 4/1975 | Kankkunen | 242/396 |
| 3,907,256 | A | * | 9/1975 | Kankkunen | 242/381 |
| 3,946,989 | A | * | 3/1976 | Tsuda | 182/241 |
| 4,359,139 | A | * | 11/1982 | Bloder | 182/234 |
| 4,416,351 | A | * | 11/1983 | Geurtsen | 182/238 |
| 4,437,546 | A | | 3/1984 | Marinoff et al. | |
| 4,457,400 | A | | 7/1984 | Donaldson et al. | |
| 4,463,830 | A | * | 8/1984 | Geurtsen | 182/238 |
| 4,469,196 | A | * | 9/1984 | Sadler | 182/236 |
| 4,480,716 | A | | 11/1984 | Soubry et al. | |
| 4,487,292 | A | | 12/1984 | Smith et al. | |
| 4,493,396 | A | * | 1/1985 | Borgia | 182/238 |
| 4,602,699 | A | * | 7/1986 | Matt | 182/234 |
| 4,653,609 | A | * | 3/1987 | Devine | 182/238 |
| 4,722,422 | A | * | 2/1988 | Hiraoka | 182/233 |
| 5,083,633 | A | * | 1/1992 | Seeger | 182/233 |
| 5,586,617 | A | * | 12/1996 | England et al. | 182/238 |
| 6,550,576 | B1 | * | 4/2003 | Meller | 182/73 |
| 6,793,038 | B2 | * | 9/2004 | Meller | 182/73 |

(Continued)

*Primary Examiner* — Alvin C. Chin-Shue
*Assistant Examiner* — Colleen M Chavchavadze
(74) *Attorney, Agent, or Firm* — Fountain Law Group, Inc.; George L. Fountain

(57) ABSTRACT

An apparatus is disclosed for safely lowering a user from a structure. The apparatus includes a frame; a spool including a cable rotatably mounted on the frame; a securing device attached to the cable and adapted to securely attached to the structure; a user support adapted to support the user and securely attached to the frame; and a pair of centrifugal hydraulic brake systems adapted to slow a rotation of the spool to cause the user support, spool and frame to descend at a safe rate for the user. In another embodiment, the apparatus includes a frame; a spool including a cable rotatably mounted on the frame; a securing device attached to the frame and adapted to securely attached to the structure; a user support adapted to support the user and attached to the cable; and a pair of centrifugal hydraulic brake systems adapted to slow a rotation of the spool to cause the user support to descend at a safe rate for the user.

14 Claims, 6 Drawing Sheets

U.S. PATENT DOCUMENTS 6,962,235 B2 * 11/2005 Leon ..... 182/73
7,475,841 B2 * 1/2009 Fancher ..... 242/381
2006/0096807 A1 5/2006 Lee
2010/0282541 A1 * 11/2010 Renton et al. ..... 182/234

* cited by examiner

APPARATUS FOR SAFELY LOWERING USER FROM STRUCTURE

FIELD

This disclosure relates generally to emergency and safety devices, and in particular, to an apparatus and method for safely lowering a user from a structure, such as a building, house, bridge, equipment or other type of structure.

BACKGROUND

Residential and commercial buildings are often equipped with many safety features in order to deal with emergency situations. For instance, buildings often include smoke detectors and alarms adapted to alert people of an on-going fire to allow them to take safety measures, such as exiting the buildings in a safe manner. Additionally, many buildings include a network of fire extinguishers and fire-protected stairwells to protect those from harm due to fire and smoke. Often, these measures of alerting and protecting building dwellers are sufficient.

On occasion, a building may be damaged in such a way as to prevent the safe egress from the building. For example, the stairwell or exit corridor may be consumed with smoke or fire. Similarly, the exit path may be blocked due to earthquake damage. In a single story building or the evacuants being on the first or perhaps second floor of a building, this may not be a problem because people may safely exit the structure through a window or door.

In situations that involve a multi-level or high-rise building, this situation of a blocked egress from the building may present a difficult or dire problem for the habitants. If, for example, some of those people are present at the lower seventh floors of a building, a fire truck ladder may be used to reach them, and bring them down in a safe manner. This is assuming that those people are able to wait out the emergency until a fire truck arrives. This may not always be the case.

In cases where the building dwellers are above the $7^{th}$ floor, other means, perhaps a rescue helicopter, may be needed to safely remove those inside the building. This may not always be possible, as in the case of the 9/11 New York City's twin tower disaster. Not only are the building dwellers susceptible to this kind of adverse situation, but fire fighters as well may get trapped in a multi-level building with no easy course-of-action to safely exit the structure. Thus, there is a need for an apparatus to facilitate a safe egress from a multi-level or high-rise building or structure.

SUMMARY

An aspect of the disclosure relates to an apparatus for safely lowering a user from a structure. The apparatus comprises a frame or housing; a spool rotatably mounted on the frame or housing, and including an associated cable or rope; a securing device attached to the cable or rope, and adapted to securely attached to the structure; a user support adapted to support the user, and securely attached to the frame; and at least one brake system adapted to slow a rotation of the spool to cause the user support to descend at a safe rate for the user.

In another aspect of the disclosure, the brake system comprises a centrifugal brake system rotatably coupled to the spool. In another aspect, the brake system comprises a hydraulic brake system. In still another aspect, the brake system comprises a centrifugal hydraulic brake system. In yet another aspect, the brake system comprises a tube or bore rotatably coupled to the spool, a piston situated longitudinally within the tube or bore, a brake pad situated at an end of the tube or bore, wherein the brake pad is adapted to make frictional contact to an internal surface of a ring member rotatably coupled to the spool; and hydraulic fluid situated within the tube or bore between the brake pad and the piston, wherein the brake pad is forced against the ring member due to centrifugal force acting upon the piston and hydraulic fluid during the rotation of the tube or bore.

In another aspect of the disclosure, the tube or bore is adapted to rotate in a direction opposite the rotation of the ring member. In still another aspect, the tube or bore is adapted to rotate faster than the rotation of the ring member. In yet another aspect, the tube or bore is rotatably coupled to the spool by way of a gear system. In an additional aspect, the gear system is configured with a defined gear ratio (e.g., ~6 to 1). In a further aspect, the gear system comprises an internal spur gear rotatably coupled to the spool, a first external spur gear rotatably coupled to the internal spur gear, and a second external spur gear rotatably coupled to the first external spur gear, wherein the tube or bore is coupled to the second external gear by way of a rotating shaft.

In still another aspect of the disclosure, the apparatus further comprises one or more fan blades coupled to the rotating shaft, wherein the one or more fan blades are adapted to cool the brake system. In also another aspect, the ring member may comprise one or more vents adapted to direct air flow towards the brake system. Additionally, the apparatus may further comprise a thermal insulating member situated between the user support and the at least one brake system. In yet another aspect, the apparatus comprises a hand brake system adapted to make frictional contact to an external surface of the ring member in response to a user activating the hand brake system. In an additional aspect, the user support comprises a harness adapted to be worn by a user and attached to the frame or housing, or a bar securely attached to the frame or housing, or a chair- or net-like structure securely attached to the frame or housing, or a member securely attached to the frame or housing and adapted to support a wheelchair.

Another aspect of the disclosure relates to an apparatus for safely lowering a user from a structure. The apparatus comprises a frame or housing; a spool rotatably mounted on the frame or housing, and including an associated cable or rope; a securing device attached to the frame or housing, and adapted to securely attach to the structure; a user support adapted to support the user and attached to the cable or rope; and at least one centrifugal hydraulic brake system adapted to slow a rotation of the spool to cause the user support to descend at a safe rate for the user. In another aspect, the apparatus may further comprise a reel-in system adapted to cause the spool to reel-in the cable or rope.

Other aspects, advantages and novel features of the present disclosure will become apparent from the following detailed description of the disclosure when considered in conjunction with the accompanying drawings.

DETAILED DESCRIPTION OF THE EXEMPLARY EMBODIMENTS

Figure 1:
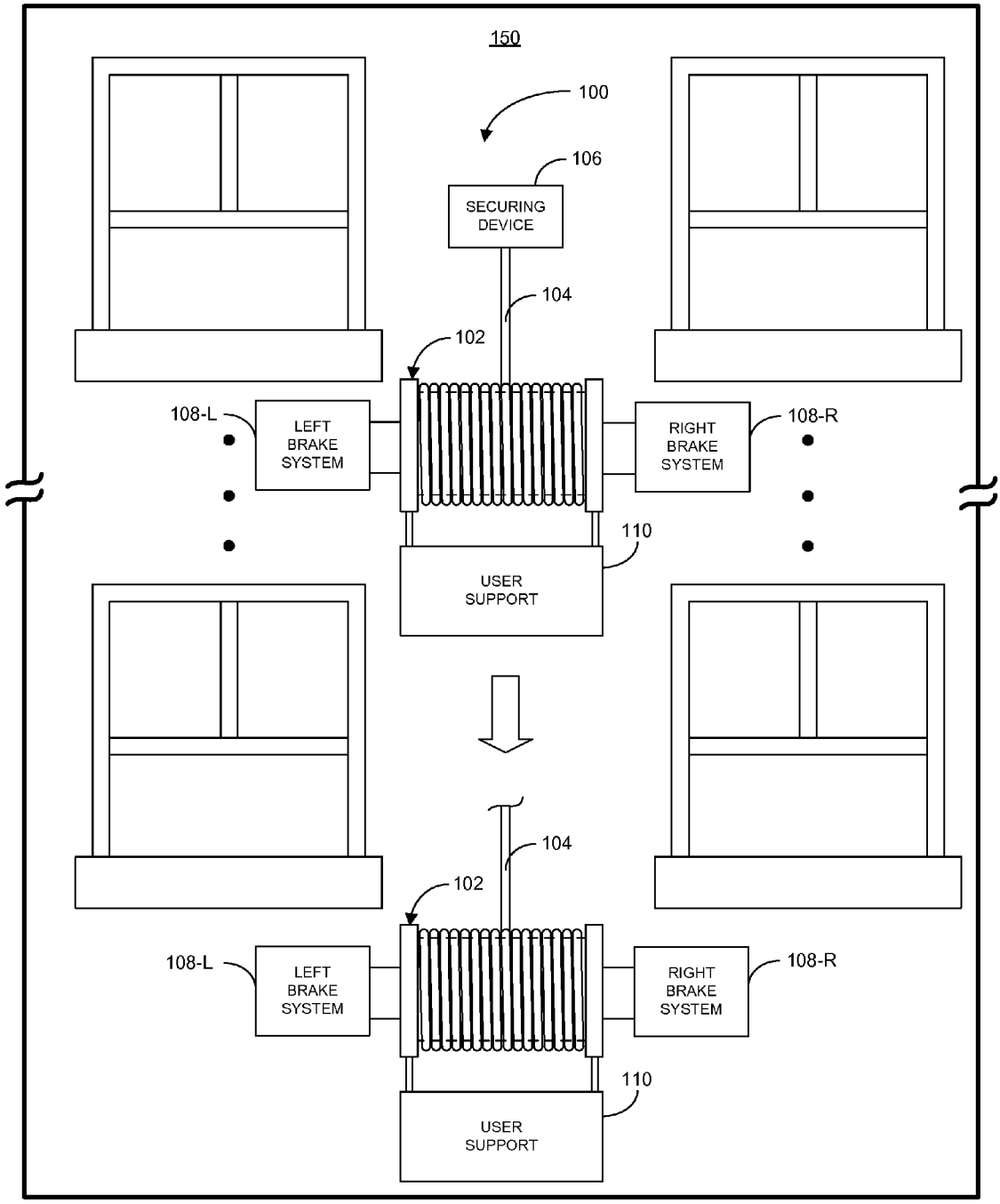
FIG. 1 illustrates a diagram of an exemplary apparatus for safely lowering a user from a structure in accordance with an aspect of the disclosure.

FIG. 1 illustrates a diagram of an exemplary apparatus 100 for safely lowering a user from a structure in accordance with an aspect of the disclosure. In summary, the apparatus 100 is adapted to safely lower or descend a user along an exterior wall or surface of a building or other structure. The apparatus 100 comprises a spool with a cable or rope having an end adapted to securely attach to the structure, a brake system adapted to slow the rotation of the spool to lower a user at a safe rate, and a support to which a user may be attached by way of a harness or other type of device.

More specifically, the apparatus 100 comprises a spool 102 including an associated cable or rope 104. Attached to an end of the cable or rope 104 is a securing device 106 for securely attaching to a building or other structure 150. The apparatus 100 further comprises a pair of brake systems 108-L and 108-R adapted to slow the rotation of the spool 102 to lower a user at a safe rate of descent, and selectively lock/unlock the rotation of the spool 102. The brake systems 108-L and 108-R may be situated on the left- and right-sides of the spool, respectively. For example, the brake systems 108-L and 108-R may be configured to lower a user at a descent rate of two (2) to 15 feet per seconds. The apparatus 100 further comprises a user support 110 adapted to support the user during the descent to ground. For example, the user support 110 may comprise a bar to be held by a user, a harness to be worn by a user, a sitting device, such as a chair- or net-like structure, and others.

In operation, a user involved in an emergency situation associated with the building or structure 150, secures the apparatus 100 to the building or structure. For example, the building 150 may have a pole, hook or other structure located on its outside wall to which the securing device 106 of the apparatus 100 may attach. Alternatively, the user may attach the securing device 106 to a fixed structure inside of the building or structure 150. The user also secures his- or herself to the user support 110, for example, by firmly holding the bar, or putting on the associated harness, or positioning him- or herself on the chair- or net-like structure.

With the brake systems 108-L and 108-R configured to lock the rotation of the spool 102, the user allows the apparatus 100 to dangle along the exterior of the building or structure 150. When the user is ready to descend, the user operates the brake systems 108-L and 108-R so as to unlock the rotation of the spool 102, thereby allowing the spool 102, brake systems 108-L and 108-R, and user support 110 to descend at a safe rate along the exterior of the building or structure 150 to ground as illustrated in FIG. 1, or to a more safe level of the building or structure 150, or another building or structure. The apparatus 100 may be configured to be relatively light and occupy a relatively small footprint, allowing the apparatus to be easily handled and conveniently stored within the building or structure 150.

Additionally, the building or structure 150 may have poles extending outwardly and downwardly from its exterior wall. For example, a plurality of poles may extend at different directions from a common anchor along the exterior wall of the building or structure. Each pole acts as a rail system allowing the securing device 106 to travel along the pole outward and downward from the exterior wall. The securing device 106 of one apparatus may be configured to attached to the securing device 106 of another apparatus at near an outward end of each pole. This prevents tangling of cable or rope of different apparatus, and allows for the repetitive use of each pole for subsequent users.

Figure 2:
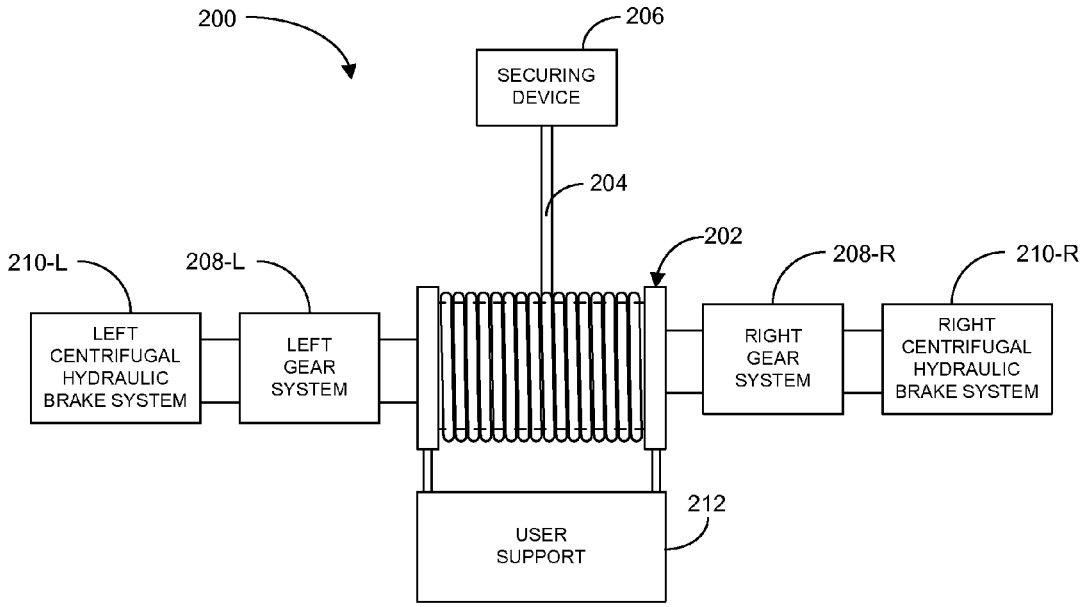
FIG. 2 illustrates a diagram of another exemplary apparatus for safely lowering a user from a structure in accordance with another aspect of the disclosure.

FIG. 2 illustrates a diagram of another exemplary apparatus 200 for safely lowering a user from a structure in accordance with another aspect of the disclosure. In summary, the apparatus 200 is similar to that of apparatus 100, except that more detail is provided with respect to the brake system. In particular, the apparatus 200 comprises a spool 202 with an associated cable or rope 204. The cable or rope 204 includes an end having a securing device 206 adapted to securely attach to a building or structure. The apparatus 200 further comprises a user support 210 by way a user is securely attached to the apparatus, as discussed above.

The apparatus 200 also includes a left brake system situated on a left side of the spool 202. The left brake system comprises a left gear system 208-L and a left centrifugal hydraulic brake system 210-L. The left gear system 208-L is rotatably coupled to the spool 202 and to the left centrifugal hydraulic brake system 210-L. Similarly, the apparatus 200 also includes a right brake system situated on a right side of the spool 202. The right brake system comprises a right gear system 208-R and a right centrifugal hydraulic brake system 210-R. The right gear system 208-R is rotatably coupled to the spool 202 and to the right centrifugal hydraulic brake system 210-R.

For example, the left and right gear systems 208-L and 208-R may have a gear ratio configured to cause the left and right centrifugal hydraulic brake systems 210-L and 210-R to rotate at a rate (e.g., 6 to 1) much faster than the rotation of the spool 202. As discussed in more detail below with reference to following embodiments, the left and right centrifugal hydraulic brake system 210-L and 210-R include a rotating brake pad that is forced against an oppositely-rotating ring-shaped member by hydraulic fluid and piston upon which centrifugal force is acting. This produces friction so as to slow the rotation of the centrifugal brake systems, and consequently the spool 202 in order to lower a user at a safe rate of descent.

Figure 3:
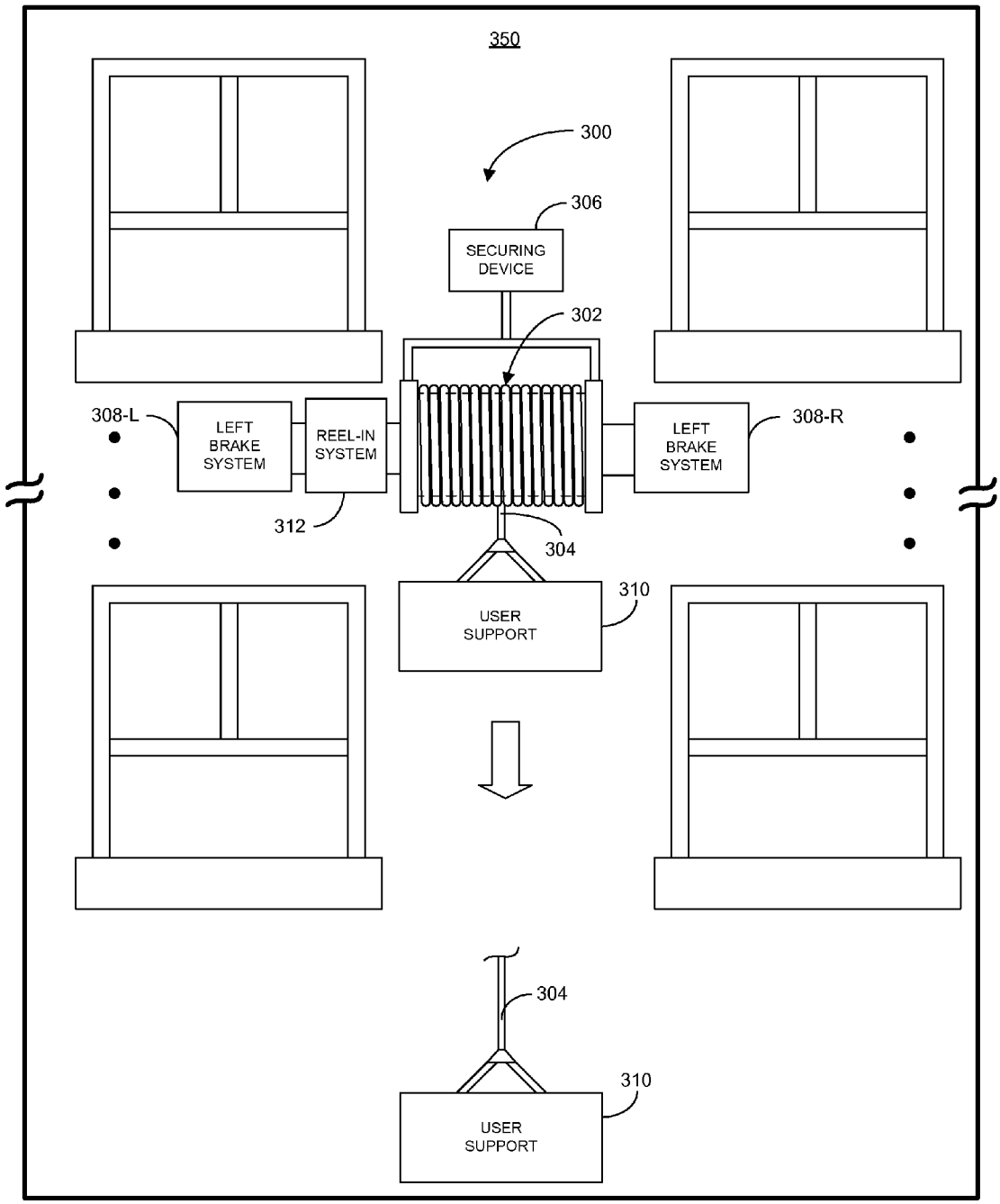
FIG. 3 illustrates a diagram of yet another exemplary apparatus for safely lowering a user from a structure in accordance with another aspect of the disclosure.

FIG. 3 illustrates a diagram of yet another exemplary apparatus 300 for safely lowering a user from a structure in accordance with another aspect of the disclosure. In summary, the apparatus 300 is similar to the apparatus 100 previously discussed, except that instead of the spool, brake systems, and user support descending together, only the user support descends.

More specifically, the apparatus 300 comprises a spool 302 including an associated cable or rope 304, a securing device 306, left and right brake systems 308-L and 308-R, and a user support 310. In this case, the spool 302 and brake systems 308-L and 308-R are fixed to the securing device 306, and thus, fixed to a building or structure 350 when the securing device is attached thereto. An end of the cable or rope 304 is securely attached to the user support 310. Accordingly, when a user unlocks the rotation of the spool 302, the gravitation force upon the user support 310 cause the cable or rope 304 to unwind from the spool 302. The left and right brake systems 308-L and 308-R ensure that the user support 310 is lowered at a safe rate of descent for the user.

The apparatus 300 may further include a reel-in system 312 adapted to cause the spool 102 to reel-in the cable or rope 304 after each use by a user. This allows a subsequent user to make use of the apparatus 300 in order to descend to a safe level. The reel-in system 312 may be a manual system (e.g., a crank) or may be an automatic system (e.g., a motor).

Figure 4:
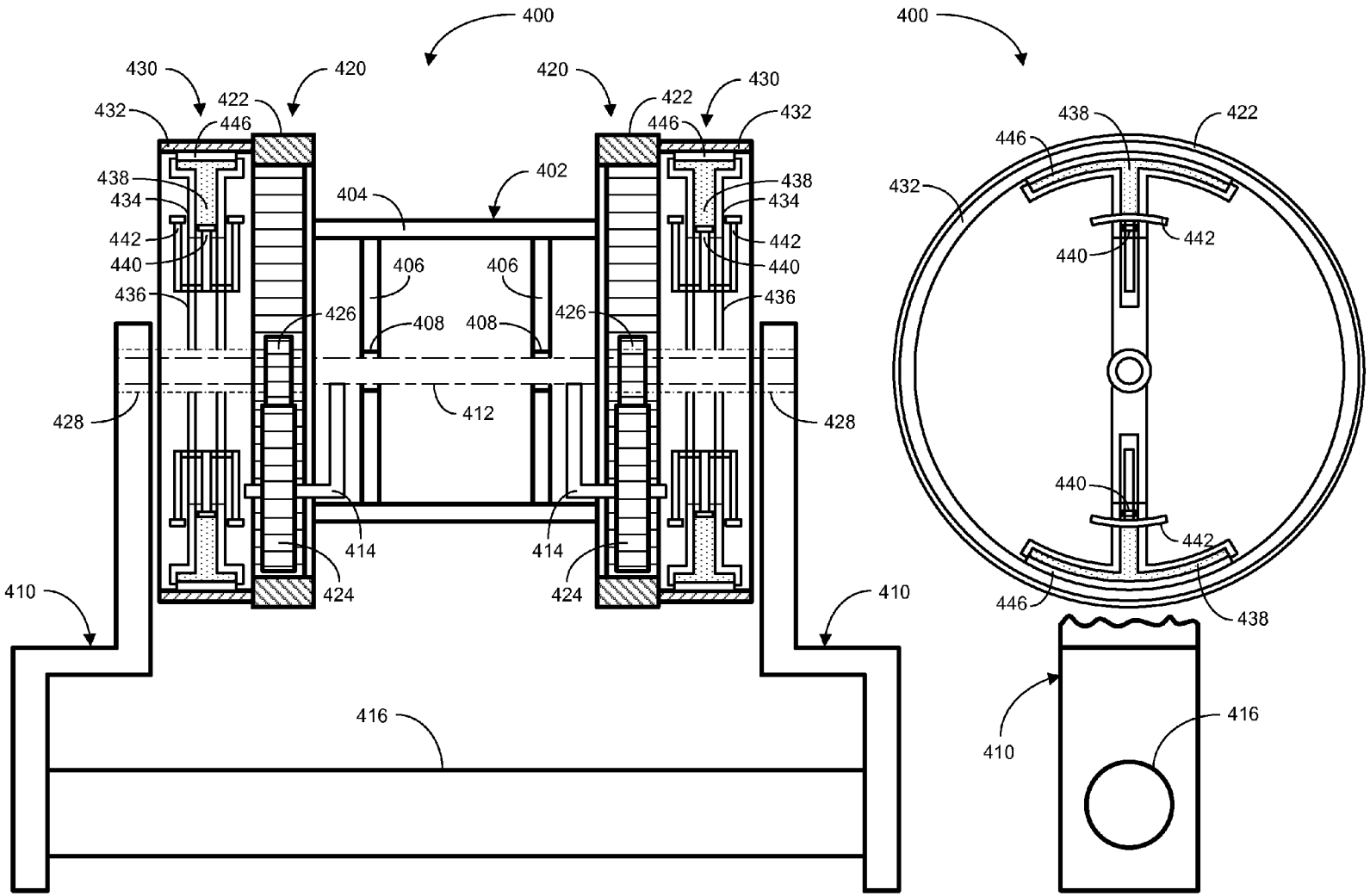
FIG. 4 illustrates a diagram of still another exemplary apparatus for safely lowering a user from a structure in accordance with another aspect of the disclosure.

FIG. 4 illustrates front sectional and partial-side views of yet another exemplary apparatus 400 for safely lowering a user from a structure in accordance with another aspect of the disclosure. In summary, the apparatus 400 may be a more detailed implementation of the apparatuses 100, 200 or 300 previously discussed. The apparatus 400 comprises a frame or housing 410, a fixed shaft 412 securely coupled to the frame or housing, and a user support member 416 also securely coupled to the frame or housing. The longitudinal axis of the fixed shaft 412 forms the rotational axis for most rotating elements in the apparatus 400, as discussed in more detail below.

The apparatus 400 further comprises a spool 402 which includes an associated cable or rope (not shown in FIG. 4). The spool 402 is rotatably mounted on the frame or housing 410 by way of the fixed shaft 412. The spool 402 comprises a cylindrical wall or drum 404 and a pair of internal transverse disk-shaped members 406, which are spaced apart from each other and attached to the internal side of the cylindrical wall or drum. Each disk-shaped member 406 includes a centrally-located opening 408 through which the fixed shaft 412 extends longitudinally. A suitable bearing (not shown) may be situated within each opening 408.

The apparatus 400 further comprises a pair of gear systems 420 rotatably coupled to the spool 402, and situated on both of sides of the spool, respectively. The gear systems 420 are rotatably mounted on the frame or housing 410 by way of the shaft 412. Each gear system 420 comprises an internal spur gear 422 and a pair of external spur gears 424 and 426. More specifically, the internal spur gear 422 is rotatably coupled to the spool 402 and to the external spur gear 424. The external spur gear 424, in turn, is rotatably coupled to external spur gear 426. These spur gears, in combination, may be configured to provide a defined gear ratio (e.g., 6 to 1). A secondary fixed shaft 414 extending from the primary fixed shaft 412, initially perpendicular and then parallel therewith, provides an axis about which external spur gear 424 rotates. A rotating shaft 428 extends from the external spur gear 426 to the frame or housing 410 along its rotational axis. Note that the external spur gear 426 and rotating shaft 428 rotate in an opposite direction as that of the spool 402, internal spur gear 422, and external spur gear 424.

The apparatus 400 further comprises a pair of centrifugal hydraulic brake systems 430 rotatably coupled to the pair of gear systems 420, respectively. Each centrifugal hydraulic brake system 430 comprises one or more tubes or bores coupled to the rotating shaft 428. Each tube or bore comprises a first portion 434 which defines an internal cavity in which hydraulic fluid 438 is situated. Each tube or bore also includes a portion 436 in which a piston 440 slides longitudinally. One or more weights 442 are coupled to the piston 440. A brake pad 446 is coupled to an end of the tube or bore, and adapted to make frictional contact with an internal side of a ring member 432 which, in turn, is coupled to the internal spur gear 422. The internal side of the brake pad 446, the tube or bore portion 434, and the piston 440 are configured to contain the hydraulic fluid, and prevent it from leaking.

In operation, as the user descends, the spool 402 reels off the cable or rope. The rotation of the spool 402 causes the opposite rotation of both centrifugal hydraulic brake systems 430 by way of the gear systems 420, respectively. Each gear system 420 may be configured to have a relatively high ratio (e.g., 6 to 1), thereby causing the brake system 430 to rotate at a much greater rate than the spool 402, and in the opposite direction. The centrifugal force acting upon the piston 440 and weights 442 compresses the hydraulic fluid 438 against the internal side of the brake pad 446. This pushes the brake pad 446 against the inside surface of the ring member 432. The rotation of the ring member 432 in one direction and the rotation of the brake pad 446 in the opposite direction and at a much greater angular rate, produces lots of friction, which slows the rotation of the centrifugal hydraulic brake systems 430, and consequently, the spool 402. The result is that the apparatus 400 lowers the user at a safe rate of descent.

Figure 5:
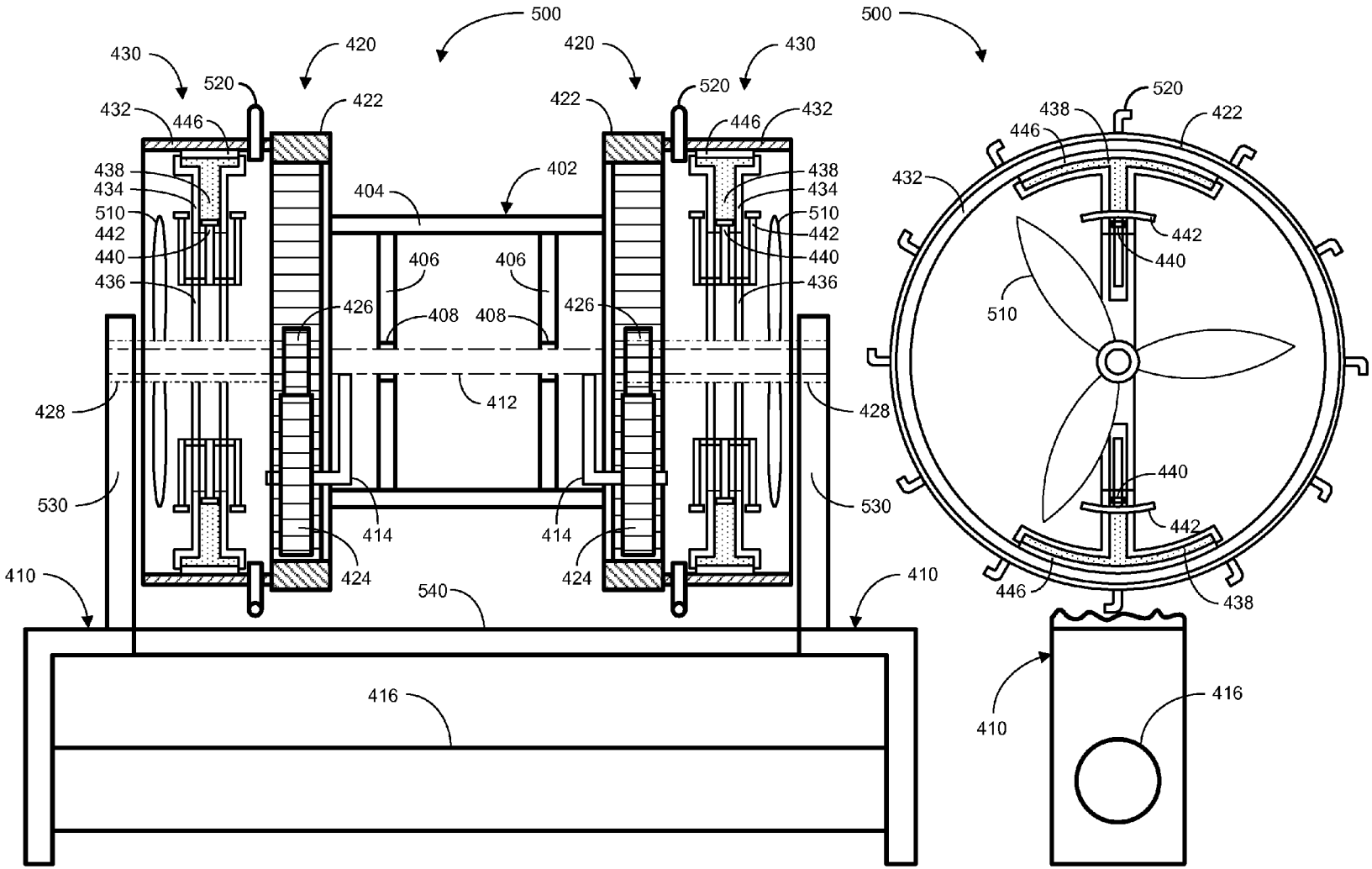
FIG. 5 illustrates a diagram of an additional exemplary apparatus for safely lowering a user from a structure in accordance with another aspect of the disclosure.

FIG. 5 illustrates front sectional and partial-side views of still another exemplary apparatus 500 for safely lowering a user from a structure in accordance with another aspect of the disclosure. The apparatus 500 is similar to apparatus 400 and includes many of the same elements as noted by the same reference numbers. The apparatus 500 further includes a pair of fans 510 situated on the outward side of respective brake systems 430. Additionally, a plurality of vents 520 are spaced-apart (e.g., every 30 degrees) along the perimeter of the ring member 432. As the ring member 432, the vents 520 bring air from the outside into the brake system 430. Each fan 510 blows the air outwardly. This provides cooling for the brake system 420 which may produce lots of heat due to friction caused by the brake pads 446 sliding along the internal surface of the ring member 432. The frame or housing 410 may include a portion 520 thereof shaped to allow smoother air flow outwardly away from the apparatus 500. Additionally, a thermal insulating member 540 may be attached to the frame or housing 410 to protect a user from the heat produced by the brake systems 420.

Figure 6:
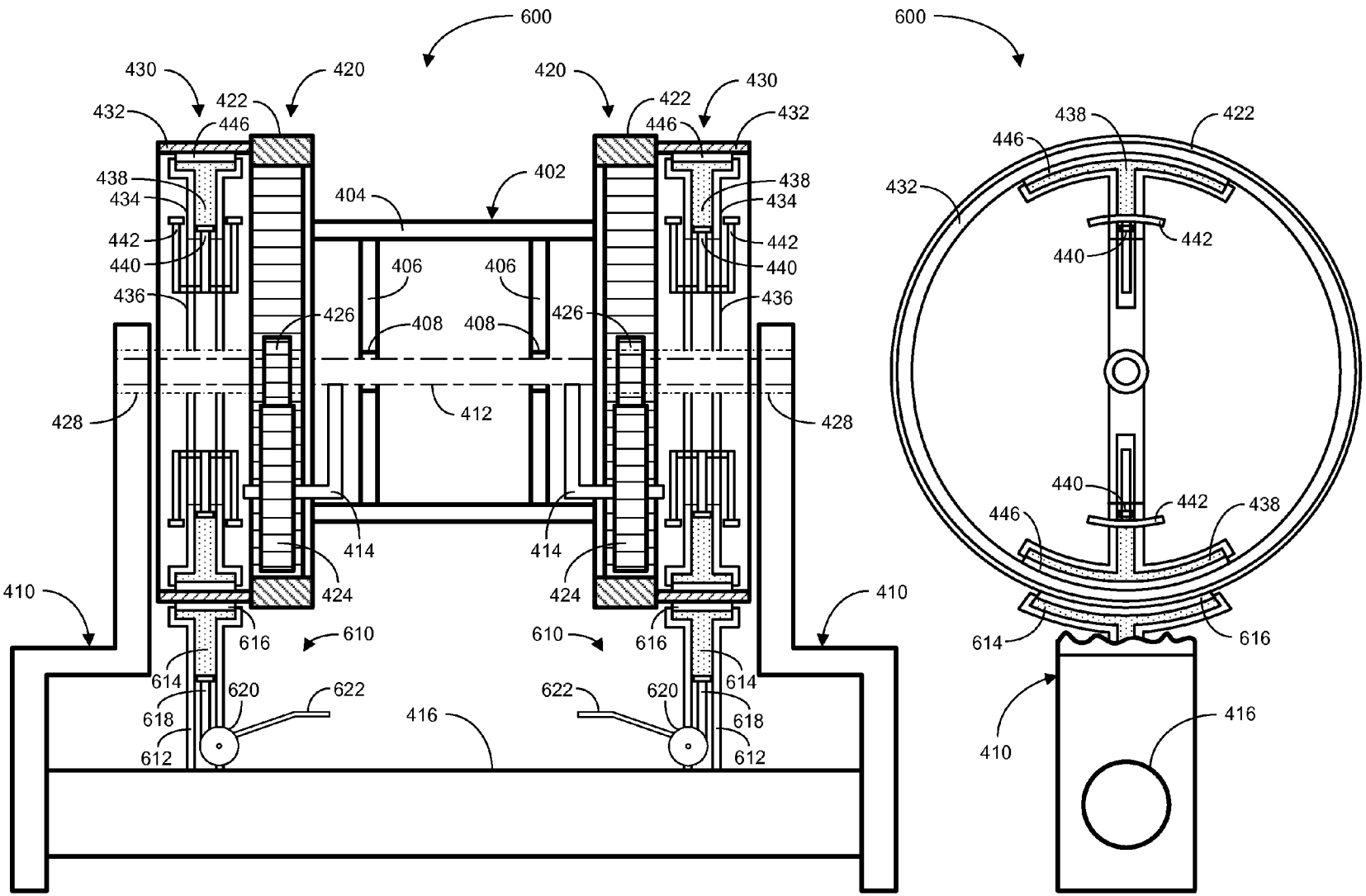
FIG. 6 illustrates a diagram of a further exemplary apparatus for safely lowering a user from a structure in accordance with another aspect of the disclosure.

FIG. 6 illustrates front sectional and partial-side views of still another exemplary apparatus 600 for safely lowering a user from a structure in accordance with another aspect of the disclosure. The apparatus 600 is similar to apparatus 400 and includes many of the same elements as noted by the same reference numbers. The apparatus 600 further comprises a pair of hand brake systems 610 to allow a user to control the rate of descent or to completely stop descending.

Each hand brake system 610 comprises a tube or bore 612 including a lower end securely coupled to the user support 416, and an upper end enclosed by a brake pad 616. Each hand brake system 610 further comprises a piston 618 situated longitudinally within the tube or bore 612. The tube or bore 612 includes an internal cavity, bounded by the brake pad 616 from above and the piston 618 from below, which is configured to contain hydraulic fluid 614 without leaking it. Each hand brake 610 further comprises a handle 622 coupled to a pivoting member 620. A lower end of the piston 618 is coupled to the pivoting member 620.

In operation, as a user squeezes or exerts a downward force on the handle 622, the pivoting member 620 exerts an upward force on the piston 618. The piston 618, in turn, pushes upward against the hydraulic fluid 614. The hydraulic fluid 614, in turn, applies pressure against the internal surface of the brake pad 616, which causes its outward surface to make higher frictional contact with the outer surface of the ring member 432. In this manner, the user may be able to control the rate of descent or even completely stop his or her descent.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An apparatus for safely lowering a user from a structure, comprising:

a frame or housing;

a spool rotatably mounted on the frame or housing, wherein the spool includes an associated cable or rope;

a securing device attached to the cable or rope, wherein the securing device is adapted to securely attach to the structure;

a user support adapted to support the user, wherein the user support is securely coupled to the frame or housing; and at least one brake system adapted to slow a rotation of the spool to cause the user support to descend at a safe rate of descent for the user, wherein the at least one of the brake system comprises:

a tube or bore rotatably coupled to the spool;

a piston situated longitudinally within the tube or bore;

a brake pad situated at an end of the tube or bore, wherein the brake pad is adapted to make frictional contact to an internal surface of a ring member rotatably coupled to the spool; and hydraulic fluid situated within the tube or bore between the brake pad and the piston, wherein the brake pad is forced against the ring member due to centrifugal force acting against the piston and hydraulic fluid during the rotation of the tube or bore.

2. The apparatus of claim 1, wherein the tube or bore is adapted to rotate in a direction opposite a rotation of the ring member.

3. The apparatus of claim 1, wherein the tube or bore is adapted to rotate faster than the ring member.

4. The apparatus of claim 1, wherein the tube or bore is rotatably coupled to the spool by way of a gear system.

5. The apparatus of claim 4, wherein the gear system is configured with a defined gear ratio.

6. The apparatus of claim 5, wherein the gear system comprises:

an internal spur gear rotatably coupled to the spool;

a first external spur gear rotatably coupled to the internal spur gear; and a second external spur gear rotatably coupled to the first external spur gear, wherein the tube or bore are coupled to the second external spur gear by way of a shaft.

7. The apparatus of claim 6, further comprising one or more fan blades coupled to the shaft, wherein the one or more fan blades are adapted cool the at least one brake system.

8. The apparatus of claim 7, wherein the ring member comprises one or more vents adapted to direct air flow towards the at least one brake system.

9. The apparatus of claim 1, further comprising at least one hand brake system adapted to make frictional contact to an external surface of the ring member in response to a user activating the at least one hand brake system.

10. The apparatus of claim 1, wherein the user support comprises a harness adapted to be worn by the user and attached to the frame or housing, a bar securely attached to the frame or housing, a chair- or net-like structure securely attached to the frame or housing, or a member adapted to support a wheelchair.

11. The apparatus of claim 1, further comprising at least one fan rotatably coupled to the spool, and adapted to direct air flow proximate the at least one brake system.

12. The apparatus of claim 1, further comprising a thermal insulating member situated between the user support and the at least one brake system.

13. The apparatus of claim 1, further comprising at least one hand brake system adapted to further slow the rotation of the spool in response to a user.

14. An apparatus for safely lowering a user from a structure, comprising:

a frame or housing;

a spool rotatably mounted on the frame or housing, wherein the spool includes an associated cable or rope;

a securing device attached to the cable or rope, wherein the securing device is adapted to securely attach to the structure;

a user support adapted to support the user, wherein the user support is securely coupled to the frame or housing; and a pair of brake systems situated on respective sides of the spool, and adapted to slow a rotation of the spool to cause the user support to descend at a safe rate of descent for the user, wherein at least one of the pair of brake systems comprises:

a tube or bore rotatably coupled to the spool;

a piston situated longitudinally within the tube or bore;

a brake pad situated at an end of the tube or bore, wherein the brake pad is adapted to make frictional contact to an internal surface of a ring member rotatably coupled to the spool; and hydraulic fluid situated within the tube or bore between the brake pad and the piston, wherein the brake pad is forced against the ring member due to centrifugal force acting against the piston and hydraulic fluid during the rotation of the tube or bore.

* * * * *